US009894737B2

(12) United States Patent
Zhang et al.

(10) Patent No.: US 9,894,737 B2
(45) Date of Patent: Feb. 13, 2018

(54) LIGHTING CONTROL SYSTEM AND METHOD

(71) Applicant: ZHEJIANG SHENGHUI LIGHTING CO., LTD, Jiaxing (CN)

(72) Inventors: Zonggen Zhang, Jiaxing (CN); Weisheng Zhou, Jiaxing (CN); Shuyu Cao, Jiaxing (CN); Jinxiang Shen, Jiaxing (CN)

(73) Assignee: ZHEJIANG SHENGHUI LIGHTING CO., LTD, Jiaxing (CN)

( * ) Notice: Subject to any disclaimer, the term of this patent is extended or adjusted under 35 U.S.C. 154(b) by 0 days.

(21) Appl. No.: 14/902,053

(22) PCT Filed: Apr. 21, 2015

(86) PCT No.: PCT/CN2015/077065
§ 371 (c)(1),
(2) Date: Dec. 30, 2015

(87) PCT Pub. No.: WO2016/033974
PCT Pub. Date: Mar. 10, 2016

(65) Prior Publication Data

US 2016/0227632 A1 Aug. 4, 2016

(30) Foreign Application Priority Data

Sep. 4, 2014 (CN) ..... 2014 1 0449527

(51) Int. Cl.
*H05B 37/02* (2006.01)
*H05B 33/08* (2006.01)

(52) U.S. Cl.
CPC ..... *H05B 37/0272* (2013.01); *H05B 33/0845* (2013.01); *H05B 37/0263* (2013.01)

(58) Field of Classification Search
CPC ..... H05B 37/0263; H05B 33/0845; H05B 37/0218; H05B 37/0209; H05B 37/0272;
(Continued)

(56) References Cited

U.S. PATENT DOCUMENTS

2002/0082748 A1* 6/2002 Enga ..... G01D 4/004 700/291
2013/0085620 A1* 4/2013 Lu ..... H04L 12/2807 700/286
(Continued)

FOREIGN PATENT DOCUMENTS

CN 103369790 A 10/2013
CN 203368836 U 12/2013
(Continued)

OTHER PUBLICATIONS

The World Intellectual Property Organization (WIPO) International Search Report for PCT/CN2015/077065 dated Jun. 29, 2014.

*Primary Examiner* — Alexander H Taningco
*Assistant Examiner* — Renan Luque
(74) *Attorney, Agent, or Firm* — Anova Law Group, PLLC

(57) ABSTRACT

The present disclosure provides a lighting control system and method thereof. The lighting control system includes: a primary lighting device having a wireless module and a plurality of secondary lighting devices. The primary lighting device and the secondary lighting devices communicate with one another by power line communication (PLC). The primary lighting device is configured to receive a control signal through at least one of power lines and the wireless module, and send the control signal to the secondary lighting devices.

20 Claims, 3 Drawing Sheets

(58) Field of Classification Search
CPC .. H05B 37/0227; H05B 37/02; H05B 37/034; H05B 37/0245; H05B 33/0815; H05B 41/14; H02J 7/35; Y02B 20/46; Y02B 20/72; Y02B 70/325; Y02B 90/224; H04L 12/2816; H04L 12/2823; H04L 12/283; Y04S 20/14; Y04S 20/228; G06F 1/26; G06F 1/32
USPC ..... 315/158, 246, 287, 224, 210, 152
See application file for complete search history.

(56) References Cited

U.S. PATENT DOCUMENTS

| | | | | |
|---|---|---|---|---|
| 2013/0187552 | A1* | 7/2013 | Frodsham | H05B 33/0845 315/152 |
| 2015/0279207 | A1* | 10/2015 | Breuer | G08C 19/16 398/106 |

FOREIGN PATENT DOCUMENTS

| | | | | |
|---|---|---|---|---|
| CN | 103925583 | A | 7/2014 | |
| CN | 103929687 | A | 7/2014 | |
| CN | 103974512 | A | 8/2014 | |
| CN | 203810352 | U | 9/2014 | |
| CN | 203813918 | U | 9/2014 | |
| CN | 104202878 | A | 12/2014 | |
| CN | 204104185 | U | 1/2015 | |
| EP | 2237483 | A1 | 10/2010 | |
| WO | WO 2009156952 | A1 * | 12/2009 | H02J 13/0006 |

* cited by examiner

LIGHTING CONTROL SYSTEM AND METHOD

CROSS-REFERENCES TO RELATED APPLICATIONS

This application is a national phase entry under 35 USC § 371(c) of PCT Application No. PCT/CN2015/077065, filed on Apr. 21, 2015, which claims the priority of Chinese Patent Application No. 201410449527.2, filed on Sep. 4, 2014, the entire content of all of which are incorporated herein by reference.

FIELD OF THE DISCLOSURE

The present disclosure generally relates to the field of lighting technologies and, more particularly, relates to a lighting control system and method.

BACKGROUND

Lighting devices often use various light sources to provide comfortable and pleasant environment with good visibility for work, living, and/or specific purposes. Nowadays, lighting devices have become more and more intelligent. In an environment such as homes, offices and other public places, lighting devices may be connected to a control device by network technologies, enabling lighting control through the network. Lighting devices have become a part of smart devices at homes, offices and other public places, to bring unique smart experience to users and to create a comfortable living environment.

Along with the development of smart technologies, home life has also become more intelligent. A variety of home terminal devices may have network communication capabilities and may be connected to a home network to perform smart controls and remote controls. The variety of home terminal devices may include audio and video equipment, lighting systems, curtain controls, air conditioning controls, security systems, digital cinema systems, network appliances, and system for automatically reading and sending utility bills. To optimize network cabling, most terminal devices are connected to the network through wireless modules. For example, lighting devices can be controlled through wireless connection. However, with increasing amount of wireless devices being used, more and more wireless signals may be present in a certain regional area, which produces a large amount of radiation and affects human health. Further, it is difficult for wireless signals to go through walls, which affects network coverage and signal stability.

Therefore, there is a need to provide a lighting control system with low level of radiation, wide range of coverage, convenient access, and flexible and stable performance. The disclosed method and system are directed to solve one or more problems set forth above and other problems in the art.

BRIEF SUMMARY OF THE DISCLOSURE

One aspect of the present disclosure provides a lighting control system, including a primary lighting device and a plurality of secondary lighting devices. The primary lighting device is configured to include a wireless module with a wireless access point. The primary lighting device and the secondary lighting devices communicate with one another by power line communication (PLC). Further, the primary lighting device is configured to receive a control signal through power lines or the wireless module, and to send the control signal to the secondary lighting devices.

One aspect of the present disclosure provides a method for configuring a lighting control system. A primary lighting device is provided to include a wireless module having a wireless access point. A plurality of secondary lighting devices is configured to communicate with the primary lighting device by power line communication (PLC). The primary lighting device is configured to receive a control signal through at least one of the wireless module and power lines, and to send the control signal to the secondary lighting devices.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiment, persons of ordinary skill in the art may derive other embodiments consistent with the present disclosure, all of which are within the scope of the present invention.

Figure 1:
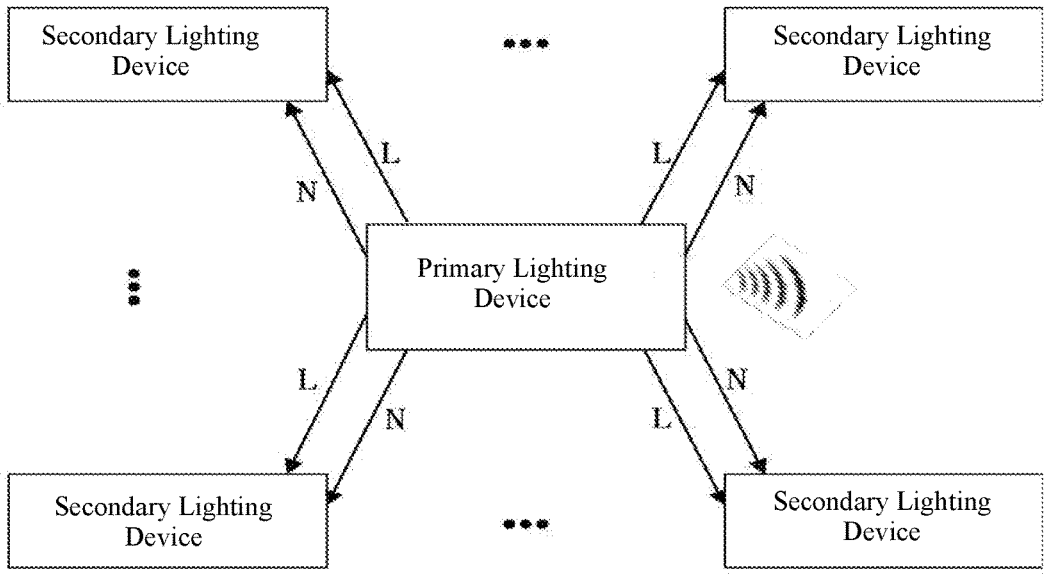
FIG. 1 is a structure diagram illustrating an exemplary lighting control system consistent with various embodiments of the present disclosure.

As shown in FIG. 1, the present disclosure provides a lighting control system, including a primary lighting device and a plurality of secondary lighting devices. The primary lighting device and the secondary lighting devices may communicate with each other, e.g., through power lines. Generally, the power lines include a live (L) wire and a neutral (N) wire. The primary lighting device may include a wireless module configured to provide a wireless access point. In certain embodiments, the wireless module can be a WI-FI module. The primary lighting device may receive control signals through the power lines or the wireless module, and send the received control signals to the secondary lighting devices. The primary lighting device may provide a wireless access point through the wireless module.

Figure 2:
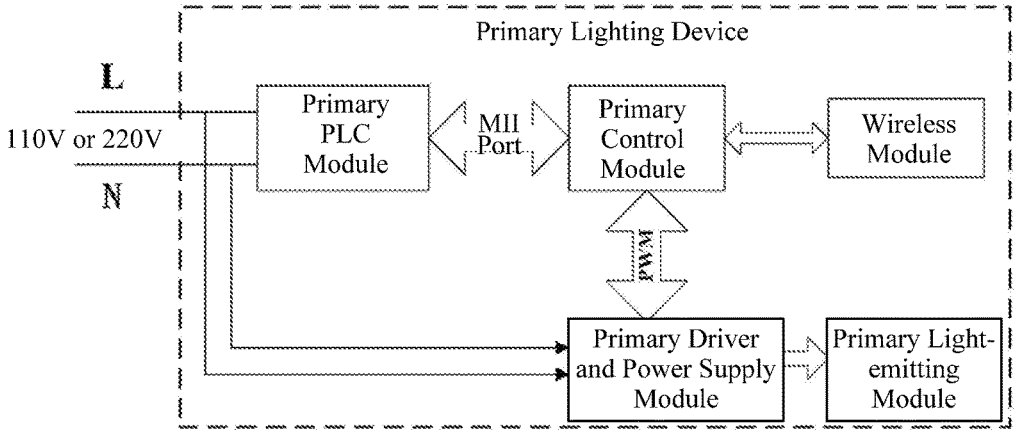
FIG. 2 is a structure diagram illustrating an exemplary primary lighting device consistent with various embodiments of the present disclosure.

As shown in FIG. 2, an exemplary primary lighting device may include a primary power line communication (PLC) module, a primary control module, a wireless module, a primary light-emitting module and a primary driver and power supply module configured to drive the primary light-emitting module and supply power to the primary lighting device. The primary lighting device may perform power line communication with the plurality of secondary lighting devices through the power lines. The primary control module and the primary PLC module are connected through a Media Independent Interface (MII) port. The primary control module may analyze and process the control signal received from the primary PLC module or the wireless module, and control the primary PLC module to send corresponding signals to the secondary lighting devices, as well as to send PWM (Pulse Width Modulation) signals to the primary driver and power supply module for controlling the primary light-emitting module, e.g., for dimming control of the lighting. The primary control module can also set the PWM signal with a constant frequency, an adjustable or a constant duty cycle, or an adjustable frequency.

Figure 3:
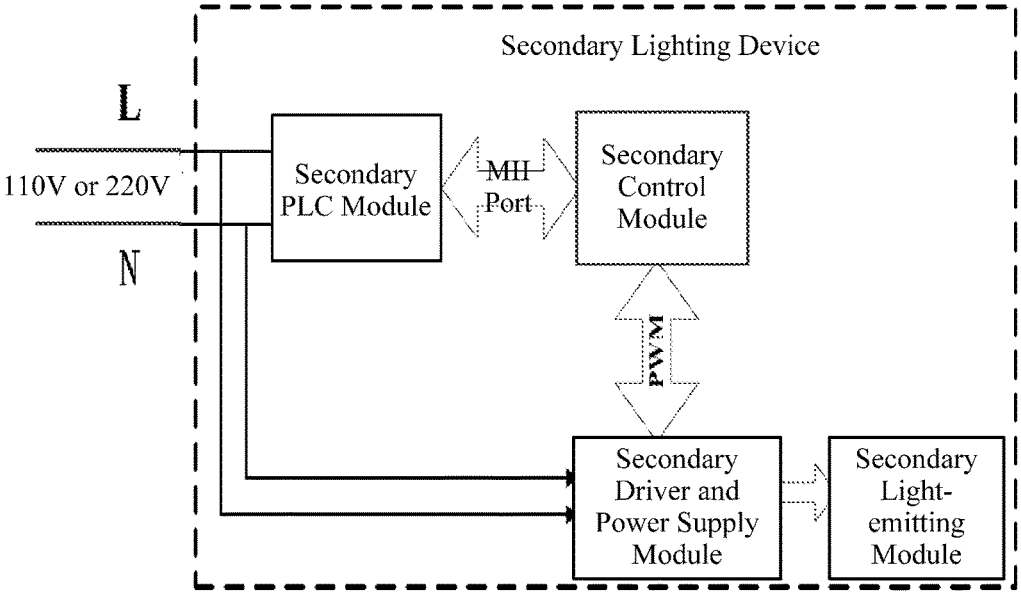
FIG. 3 is a structure diagram illustrating an exemplary secondary lighting device consistent with various embodiments of the present disclosure.

As shown in FIG. 3, an exemplary secondary lighting device may include a secondary PLC module, a secondary control module, a secondary light-emitting module and a secondary driver and power supply module configured to drive the secondary light-emitting module and supply power to the secondary lighting device. The secondary lighting device may perform power line communication with the primary PLC module of the primary lighting devices through the secondary PLC module. The secondary control module and the secondary PLC module are connected through an MII port. The secondary control module may analyze and process the control signals received from the primary lighting device, and send PWM signals to the secondary driver and power supply module for controlling the secondary light-emitting module, e.g., for dimming control of the lighting. The secondary control module can also set the PWM signal with a constant frequency, an adjustable or a constant duty cycle, and an adjustable frequency.

In some embodiments, the secondary lighting device may not include a wireless module. In other embodiments, however, the secondary lighting device may include a wireless module such as a WI-FI module to provide a wireless access point to the secondary lighting device. In this case, any of the primary lighting device and secondary lighting device may use their own wireless AP function of the wireless module to connect to any home terminal, and to respectively send control signal to the home terminal to therefore control the home terminal. For example, the secondary lighting device may receive the control signal from the primary lighting device and/or may receive the control signal from a different secondary lighting device, e.g., through corresponding power lines or the wireless module.

In certain embodiments, in a home or an office environment, the driver and power supply module and the power line communication works under a residential voltage, such as 110 Volt or 220 Volt.

In one embodiment, the lighting control system may further include a smart control terminal having wireless communication capabilities. The smart control terminal may function as a control terminal of the lighting devices and send control signals to the wireless module of the primary lighting device. The smart control terminal may be a smart phone, a laptop computer, a tablet computer, or a personal computer. The smart control terminal may be installed with an APP (Application) for controlling the lighting devices. After wirelessly connecting to the primary lighting device, the smart control terminal may send the control signals through the APP.

Figure 4:
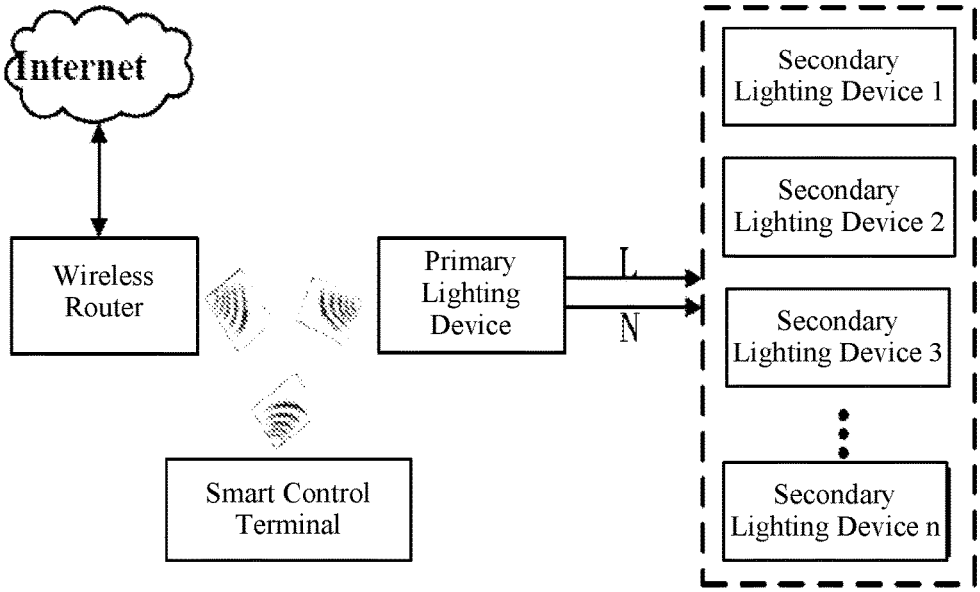
FIG. 4 is a structure diagram illustrating a lighting control system consistent with one exemplary embodiment in the present disclosure.

As shown in FIG. 4, in one exemplary embodiment consistent with the present disclosure, the primary lighting device may connect to the Internet through a wireless router. The primary lighting device may wirelessly connect to the wireless router through the wireless module. The primary lighting device may receive control signals from a cloud in the Internet, as well as directly from the smart control terminal. The smart control terminal may first connect to the wireless router for connecting with the primary lighting device, and then send control signals.

In another exemplary embodiment, the primary lighting device may connect to the Internet directly.

Figure 5:
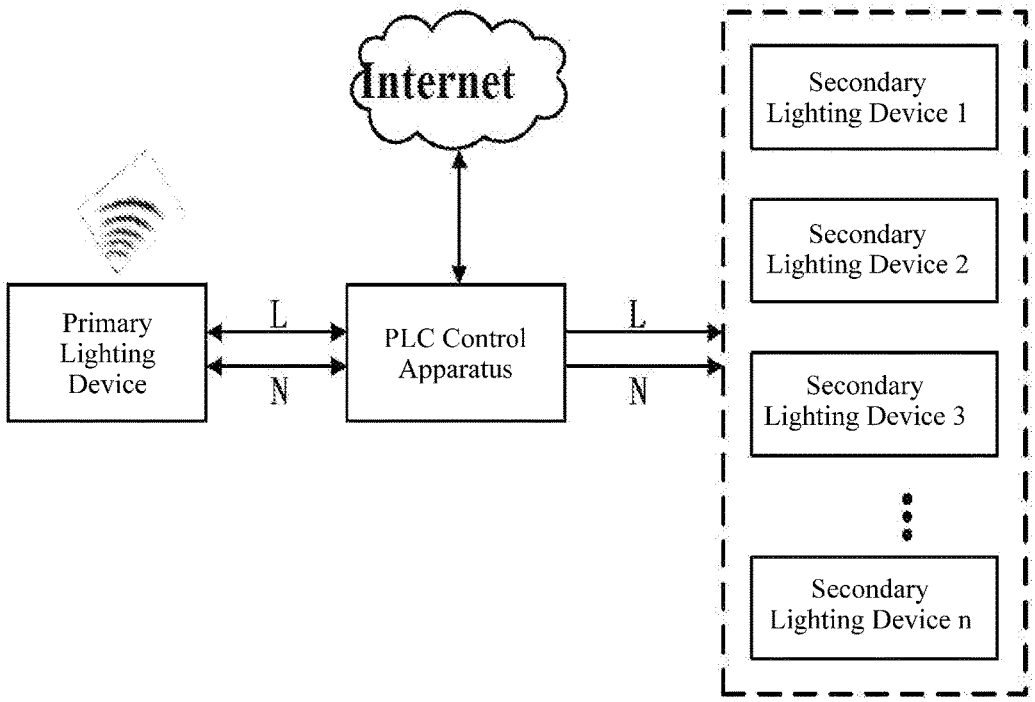
FIG. 5 is a structure diagram illustrating a lighting control system consistent with another exemplary embodiment in the present disclosure.

As shown in FIG. 5, in another exemplary embodiment, the lighting control system may further include a PLC control apparatus. The PLC control apparatus may connect to the primary lighting device and the secondary lighting devices through the power lines. The PLC control apparatus may receive control signals for the primary lighting device and the secondary lighting devices, or send control signals processed by the primary lighting device to secondary lighting device 1, secondary lighting device 2, secondary lighting device 3, . . . , and secondary lighting device n (e.g., as shown in FIG. 1). The smart control terminal may send the control signals by wirelessly connecting to the primary lighting device. When the primary lighting device and the wireless router are connected, the control signals may also be sent from the Internet. Further, the PLC control apparatus may connect to the Internet and receive control signals directly from the Internet.

The PLC control apparatus may be configured to receive information-containing high-frequency signals added to an electric current, and separate the information-containing high-frequency signals from the electric current. After being analyzed and processed, the separated signals are sent to a corresponding primary lighting device or a corresponding secondary lighting device. The PLC control apparatus are configured to centralize and transmit control signals based on the power lines. The PLC control apparatus may include a microprocessor, a power line carrier chip, a communication interface circuit, a power line coupling circuit, and other suitable hardware. Understandably, any design strategy that can implement the functions of the PLC control apparatus may be included in the present disclosure.

In certain embodiments, the PLC control apparatus may be built to fit a power socket outlet. For example, in a working space or a home-living space, various rooms in the space may install the disclosed primary lighting device and the secondary lighting devices. The PLC control apparatus may just be plugged into a socket to connect to the lighting devices through the power lines. Therefore, a user may conveniently send control signals to the PLC control apparatus and to control the lighting devices, either through the Internet or a smart control terminal.

It should be noted that, in above embodiments, when connected to the Internet, the lighting control system may receive control signals from the cloud or the smart control terminal and perform controls over the primary lighting device and the secondary lighting devices. When not connected to the Internet, the lighting control system may receive control signals from the smart control terminal in local area network and perform controls.

In certain embodiments, the primary light-emitting module and the secondary light-emitting module may be LED light-emitting modules. The driver and power supply module may be an LED driver and power supply module. That is, the lighting device may be an LED lighting device. Compared to a secondary LED lighting device, a primary LED lighting device may additionally include/provide a WI-FI module. According to actual environment and locations, one LED lighting device may be selected and configured to provide the additional WI-FI module and become the primary LED lighting device.

In various embodiments, the secondary LED lighting device may or may not include a WI-FI module and may or may not be connected to the Internet, cloud, or other similar network.

For example, the secondary LED lighting device may include a wireless module such as a WI-FI module to provide a wireless AP function to the secondary LED lighting device. In this case, any of the primary LED lighting device and secondary LED lighting device may use their own wireless AP function of the wireless module to connect to any home terminal, and to respectively send control signal to the home terminal to therefore control the home terminal. For example, the secondary LED lighting device may receive the control signal from the primary LED lighting device and/or may receive the control signal from a different LED secondary lighting device, e.g., through corresponding power lines or the wireless module.

LED technologies provide many advantages in energy conservation, environmental protection, controllable lighting, solid state lighting, great stability, short response time, long operational lifetime, etc. To promote low carbon living and protect environment, LED technologies have been widely adopted in various lighting applications. LED lighting is the development trend of efficient and environmental friendly lighting, having unique power supply and control method which allows easy integration of various intelligent control and multimedia functions.

LED lighting devices are provided with other various intelligent modules, such as speakers, security and surveillance units, etc. The networking method disclosed herein allows the smart control terminal to control the intelligent modules in the LED lighting devices. The primary LED lighting devices may provide a WI-FI hot spot, allowing various other smart devices with wireless communications capabilities to access the network and to get on the Internet. The smart devices may include, for example, a smart phone, a computer, a smart refrigerator, a smart air-conditioner, etc. These smart devices may be controlled through the primary LED lighting device. Such configuration has wide applications and enables flexible networking.

For example, primary LED lighting device may be used for smart home control to control a plurality of household electrical appliances by the primary control module according to the control signal sent from the smart control terminal.

In various embodiments, the household electrical appliances may have the PLC control capacities and may be controlled by the primary LED lighting device. The primary LED lighting device may switch on/off the household electrical appliances, and/or change parameters of the household electrical appliances (e.g., setting/altering a temperature for refrigerator or air conditioner, setting/altering a time for starting a dishwasher, etc.). The primary LED lighting device may monitor the status of the home appliances. The primary LED lighting device may further manage the secondary lighting devices based on the status of certain home appliances. For example, if the primary lighting device detects that the refrigerator in the kitchen is down, it may set the secondary lighting device in the kitchen to flash or to a different light color to indicate that the refrigerator is down.

In certain embodiments, the lighting devices including primary and secondary lighting devices can each include a heat dissipation configuration. For example, the lighting devices may adopt a heat dissipation module, such as aluminum fins, heat pipe, heat sink, fans, etc. The lighting devices may also employ materials with high thermal conductivity for housing and various components inside the lighting devices.

In one example, a lighting device of the primary and secondary lighting devices can include an LED lamp device configured with a heat dissipation lamp cup, which can include a hollow structure (e.g., socket-configured). The hollow structure can be formed between an interior surface of the heat dissipation lamp cup and internal components including the control module, the PLC module, the light-emitting module and/or the driver and power supply module. The hollow structure may provide a ventilation gap to allow air circulation and thus heat dissipation between a top and a bottom of the LED lamp device.

In some embodiments, a PLC module may be configured as a separate component coupled with an LED lighting device with a control module. The shape of the PLC module and the shape of the LED lighting device may therefore be designed to be coupled with each other. Further, the PLC module may provide a heating dissipating surface, a hollow structure, or a gap to facilitate heat dissipation of the LED lighting device.

Further, optionally, outer cooling plates may be longitudinally configured and circumferentially distributed along an outer periphery of the heat dissipation lamp cup to facilitate heat dissipation. Optionally, a plurality of inner cooling plates may be longitudinally configured and distributed within the ventilation gap. The ventilation gap may encompass the PLC module.

Other embodiments of the disclosure will be apparent to those skilled in the art from consideration of the specification and practice of the invention disclosed herein. It is intended that the specification and examples be considered as exemplary only, with a true scope and spirit of the invention being indicated by the claims.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

The disclosed lighting control system adopts wireless networking and power line networking technologies to build desired network. Power line communication provides several advantages including: e.g., free of radiation and strong signal even when going through walls. The secondary lighting devices in the disclosed lighting control system do not need to have wireless modules, and may communicate with the primary lighting device through PLC without extra wiring arrangements. Users may conveniently connect a lighting device to the lighting control system according to existing locations of the power line. The conventionally needed operations to set up a network, including wiring, testing, and/or debugging, may not be necessary in embodiments consistent with the present disclosure.

In certain embodiments, only the primary lighting device is provided with a wireless module to limit radiation in a home. The wireless module of the primary lighting device may be configured to have a wireless access point, which can receive control signals wirelessly and provides wireless hot spot for other smart devices, e.g., in a smart home. The disclosed lighting control system builds a control network through a primary lighting device and a plurality of secondary lighting devices. Such network has wide coverage, easy access, great flexibility, and good network stability.

What is claimed is:

1. A lighting control system, comprising:

a primary lighting device including a wireless module;

a plurality of secondary lighting devices; and a power line communication (PLC) control apparatus having a microprocessor, a power line carrier chip and a power line coupling circuit, wherein the PLC control apparatus is connected with the primary lighting device and the plurality of secondary lighting devices through power lines, respectively;

wherein:

the primary lighting device is configured to receive and process a control signal through at least one of power lines and the wireless module, and send the control signal to the PLC control apparatus after the control signal is processed, and the microprocessor of the PLC control apparatus, coupled to the power line carrier chip and the power line coupling circuit, is configured to:

send the processed control signal received from the primary lighting device to the plurality of secondary lighting devices through the power lines, receive a second control signal directly from Internet, centralize and process the second control signal, and send the processed second control signal to the primary lighting device and the plurality of secondary lighting devices through the power lines.

2. The lighting control system according to claim 1, wherein the primary lighting device further comprises:

a primary PLC module configured to communicate with the PLC control apparatus through the power lines;

a primary light-emitting module;

a primary driver and power supply module configured to drive the primary light-emitting module and to supply power to the primary lighting device; and a primary control module configured to analyze and process the control signal from the at least one of the power lines and the wireless module, to control the primary light-emitting module to emit light, and to control the primary PLC module to send the control signal to the PLC control apparatus.

3. The lighting control system according to claim 1, wherein each of the secondary lighting devices comprises:

a secondary PLC module configured to communicate with the PLC control apparatus through the power lines;

a secondary light-emitting module;

a secondary driver and power supply module configured to drive the secondary light-emitting module and supply power to the corresponding secondary lighting device; and a secondary control module configured to analyze and process the control signal from the PLC control apparatus, and to control the secondary light-emitting module to emit light.

4. The lighting control system according to claim 1, wherein each of the secondary lighting devices further includes a wireless module to receive and send out the control signal.

5. The lighting control system according to claim 1, further comprising:

a smart control terminal having wireless communication capabilities configured to send the control signal to the wireless module of the primary lighting device.

6. The lighting control system according to claim 5, wherein the smart control terminal is a smart phone, a laptop computer, a tablet computer, or a personal computer.

7. The lighting control system according to claim 1, wherein the primary lighting device connects to the Internet and receives the control signal from the Internet.

8. The lighting control system according to claim 7, wherein the primary lighting device connects to the Internet through the wireless module.

9. The lighting control system according to claim 8, further comprising: a wireless router configured to connect to the Internet, wherein the primary lighting device connects to the wireless router through the wireless module.

10. The lighting control system according to claim 1, wherein the wireless module is a WI-FI module.

11. The lighting control system according to claim 1, wherein the primary lighting device and the secondary lighting devices are LED lighting devices.

12. The lighting control system according to claim 2, wherein the primary control module is further configured to send the control signal to a smart device for controlling the smart device, and the smart device includes at least one of a smart refrigerator and a smart air-conditioner.

13. The lighting control system according to claim 1, wherein the PLC control apparatus is plugged into a socket to establish connection with the primary lighting device and the plurality of secondary lighting devices through the power lines.

14. The lighting control system according to claim 1, wherein: the PLC control apparatus is connected with each of the plurality of secondary lighting devices through the power lines in a parallel connection.

15. The lighting control system according to claim 2, wherein: the primary control module and the primary PLC module are connected through a Media Independent Interface (MII) port; and the primary control module controls the primary PLC module to send Pulse Width Modulation (PWM) signals to the primary driver and power supply module for controlling the primary light-emitting module.

16. A method for configuring a lighting control system, comprising:

providing a primary lighting device including a wireless module;

providing a plurality of secondary lighting devices;

providing a power line communication (PLC) control apparatus having a microprocessor, a power line carrier chip and a power line coupling circuit;

configuring the PLC control apparatus connected with the primary lighting device and the plurality of secondary lighting devices through power lines, respectively;

wherein:

the primary lighting device is configured to receive and process a control signal through at least one of the wireless module and power lines, and send the control signal to the PLC control apparatus after the control signal is processed, and the microprocessor of the PLC control apparatus, coupled to the power line carrier chip and the power line coupling circuit, is configured to: send the processed control signal received from the primary lighting device to the plurality of secondary lighting devices through the power lines, receive a second control signal directly from Internet, centralize and process the second control signal, and send the processed second control signal to the primary lighting device and the plurality of secondary lighting devices through the power lines.

17. The method according to claim 16, wherein the primary lighting device further comprises:

a primary PLC module configured to communicate with the PLC control apparatus through the power lines;

a primary light-emitting module;

a primary driver and power supply module configured to drive the primary light-emitting module and to supply power to the primary lighting device; and a primary control module configured to analyze and process the control signal from the at least one of the power lines and the wireless module, to control the primary light-emitting module to emit light, and to control the primary PLC module to send the control signal to the PLC control apparatus.

18. The method according to claim 16, wherein each of the secondary lighting devices comprises:

a secondary PLC module configured to communicate with the PLC control apparatus through the power lines;

a secondary light-emitting module;

a secondary driver and power supply module configured to drive the secondary light-emitting module and supply power to the corresponding secondary lighting device; and a secondary control module configured to analyze and process the control signal from the PLC control apparatus, and to control the secondary light-emitting module to emit light.

19. The method according to claim 16, wherein each of the secondary lighting devices further includes a wireless module to receive and send out the control signal.

20. A lighting control system, comprising:

a primary lighting device including a wireless module;

a plurality of secondary lighting devices; and a power line communication (PLC) control apparatus having a microprocessor, a power line carrier chip and a power line coupling circuit, wherein the PLC control apparatus is connected with the primary lighting device and the plurality of secondary lighting devices through power lines, respectively;

wherein:

the primary lighting device is configured to receive and process a control signal through a power line, and send the control signal to the PLC control apparatus after the control signal is processed;

the microprocessor of the PLC control apparatus, coupled to the power line carrier chip and the power line coupling circuit, is configured to: send the processed control signal received from the primary lighting device to the plurality of secondary lighting devices through the power lines, receive a second control signal directly from Internet, centralize and process the second control signal, and send the processed second signal to the primary lighting device and the plurality of secondary lighting devices through the power lines; and the PLC control apparatus is plugged into a socket to establish connection with the primary lighting device and the plurality of secondary lighting devices through the power lines.

* * * * *